United States Patent [19]

Bellanca

[11] 4,153,277

[45] May 8, 1979

[54] RECORD KEEPING SYSTEM

[75] Inventor: Gary J. Bellanca, Mount Sinai, N.Y.

[73] Assignee: Wright Line Inc., Worcester, Mass.

[21] Appl. No.: 880,783

[22] Filed: Feb. 24, 1978

[51] Int. Cl.[2] ..... B41L 1/20

[52] U.S. Cl. ..... 282/9 R; 282/8 R; 282/24 R; 783/21

[58] Field of Search ..... 282/23 R, 23 A, 9 R, 282/9 A, 8 R, 29 B, DIG. 1, 24 R, DIG. 2, 28 R; 283/21

[56] References Cited

U.S. PATENT DOCUMENTS

| | | | |
|---|---|---|---|
| 861,228 | 7/1907 | Turck | 282/8 R |
| 1,299,643 | 4/1919 | Wernery | 282/23 R |
| 2,869,898 | 1/1959 | Martin | 282/9 R |
| 3,177,010 | 4/1965 | Stroh | 282/23 R |
| 3,625,547 | 12/1971 | Burke | 283/21 X |
| 4,002,356 | 1/1977 | Weidmann | 282/8 R X |

FOREIGN PATENT DOCUMENTS

| | | | |
|---|---|---|---|
| 54378 | 2/1938 | Denmark | 282/8 R |

*Primary Examiner*—William R. Briggs
*Attorney, Agent, or Firm*—Milton E. Gilbert

[57] ABSTRACT

A record keeping system comprises (1) a multiple sheet assembly including a label with an adhesive backing and registration means including an adhesive backed flap and (2) a master ledger sheet for recording a plurality of entries. The multiple sheet assembly is used with the master ledger sheet by securing the flap of the assembly to the back of the master ledger sheet in proper registration so that information provided on the label assembly will simultaneously be transferred to the master ledger sheet.

9 Claims, 6 Drawing Figures

RECORD KEEPING SYSTEM

This invention relates generally to record keeping systems and more particularly to composite, multiple-sheet, record keeping systems.

Commercially available record keeping systems of the type having multiple sheets, typically an original sheet with multiple carbon copies, are many and varied. See, for example, U.S. Pat. Nos. 4,029,341, 4,021,060, 3,969,634, 3,625,547 and the references cited therein. In accordance with legal requirements, some of these record keeping systems, particularly those used to manage the dispensing of prescription products such as pills, capsules and the like, include a master ledger sheet to record all prescriptions filled for a particular individual or family during a given time period by the pharmacy keeping the records. One of these latter systems, described in U.S. Pat. No. 3,625,547 includes superimposed prescription and ledger card labels so that the labels are completed simultaneously wherein the prescription label can be subsequently secured to the prescription package itself and the ledger card label can be adhesively secured to a master ledger card. Adhesively securing the label to the master ledger card requires time and can provide problems due to the fact that one must work with the exposed adhesive on the label when attaching the label to the master ledger card, which in turn (1) can cause the ledger card label to be folded over on itself, making it difficult to separate, and (2) can be difficult to properly register on the appropriate portion of the ledger card.

It is an object of the present invention to provide an easy to use record keeping system particularly adapted for use in pharmacies and other like prescription dispensaries.

Another object of the present invention is to provide a novel record keeping system adapted so that all entries including those on the master ledger sheet can be made simultaneously as, for example, with a typewriter.

Yet another object of the present invention is to provide a novel, record keeping system, of the type including an adhesive backed prescription label which is adapted so that information provided on the prescription label can be simultaneously provided on multiple copies as well as a master ledger sheet.

Still another object of the present invention is to provide a record keeping system which includes a master ledger sheet for recording a plurality of entries and a multiple sheet assembly including an adhesive backed label. The ledger card and assembly employ novel registration and indexing techniques for properly aligning each multiple sheet assembly with the ledger sheet, whereby information recorded on the assembly is transferred onto and corresponds with the particular entry to be made on the master ledger sheet.

These and other objects are achieved by a record keeping system comprising, in combination, at least one master ledger sheet and a multiple sheet label assembly. The front of the ledger sheet is provided with indicia for dividing the sheet into a plurality of entry portions for receiving a like plurality of record keeping entries. The master ledger sheet is also provided with suitable indexing means for properly registering each label assembly with the sheet depending on which portion of the sheet the entry is to be made. The label assembly comprises registration means, cooperative with the indexing means, so that the assembly can be properly positioned with respect to the particular portion of the ledger sheet on which the entry is to be made, at least two sheets detachably secured to one another so as to maintain the sheets in a superimposed relationship, and pressure responsive duplicating means for transferring information from one sheet of said assembly to another and to the master ledger sheet. The registration means includes a flap having an adhesive coating on one side detachably secured to at least one of the sheets and foldable with respect to the sheets of the assembly. The system is designed so that when the edge of the ledger sheet is inserted between the flap on the one hand and the sheets of the assembly on the other, the flap can be secured to the back surface of the ledger sheet by the adhesive coating with the assembly positioned so that preselected information written on the top sheet of the assembly will be recorded on the sheets therebelow. At least one sheet of the label assembly includes an adhesive backing so that the sheet can be used as a prescription label.

Other features and many attendant advantages of the invention are set forth in or rendered obvious by the following detailed description which is to be considered together with the accompanying drawings wherein.

In the drawings, the same numerals are used to denote like parts. Further, some dimensions of the parts of the system shown have been exaggerated for ease of exposition.

Figure 1:
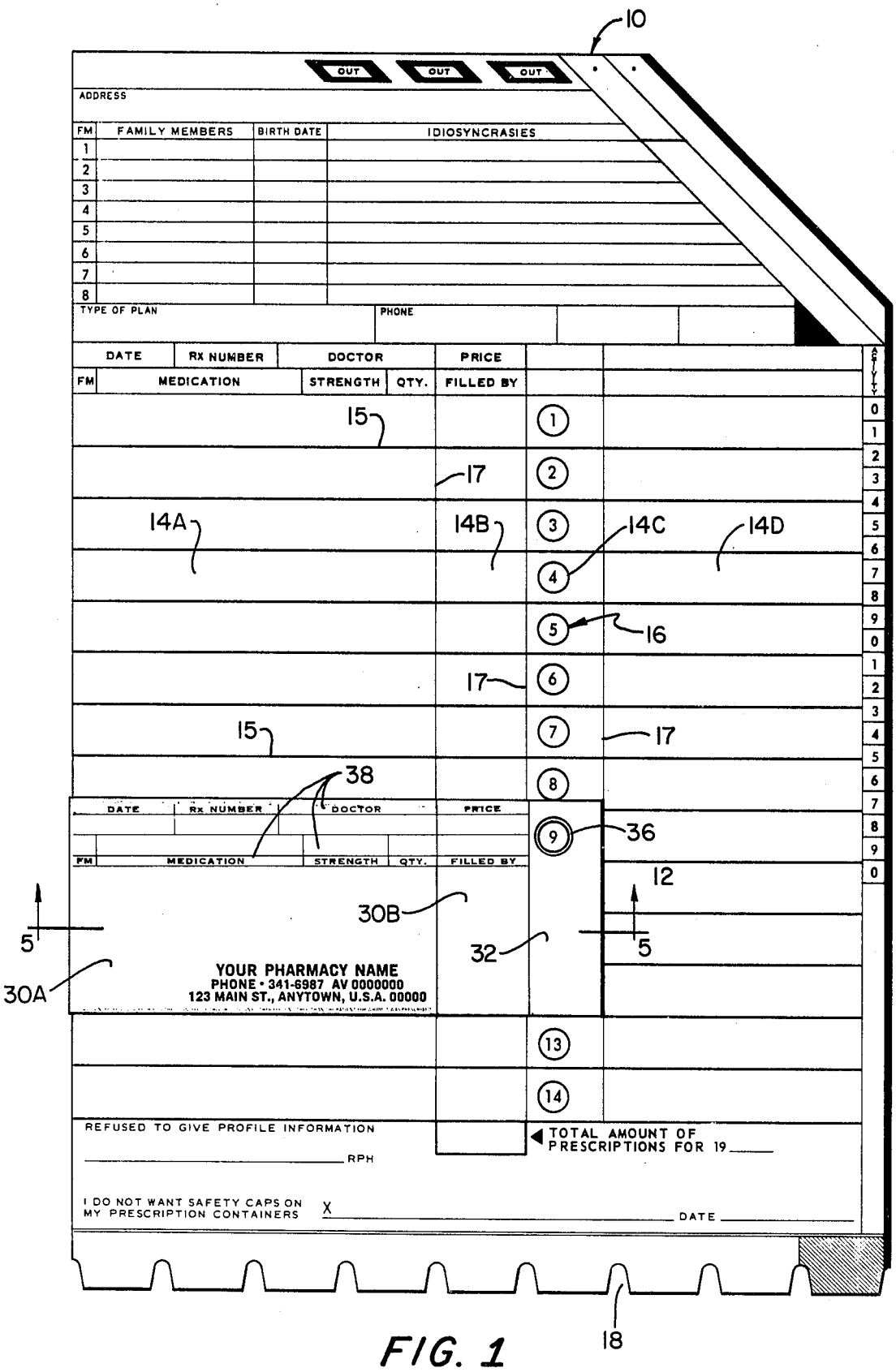
FIG. 1 illustrates a record keeping system for pharmaceutical prescriptions incorporating the principles of the present invention and assembled for use.
Figure 2:
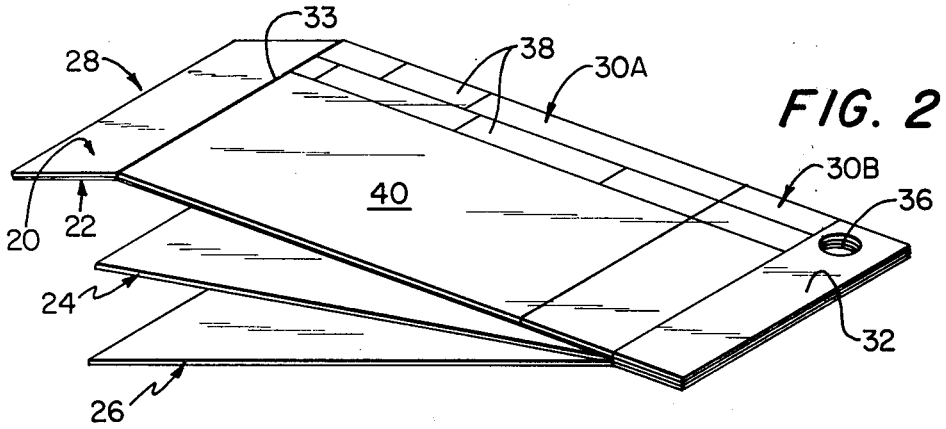
FIG. 2 is a top perspective view of a label assembly of the system of FIG. 1.

Referring to FIGS. 1–5, the record keeping system of the present invention comprises the master ledger sheet 10 and the multiple-sheet label assembly 12. The sheet 10 is shown with typical legend for use in dispensaries, pharmacies and the like. The legend includes spaces for writing in information regarding, for example, the particular family whose record is being kept, notably family address, family members, birth dates and any idiosyncrasies which may be of interest to the record keeper. At least a part of the master ledger sheet 10 is divided into a plurality of entry, further subdivided by columns, for recording a like plurality of transactions. Each entry line is preferably demarcated by horizontal lines 15 across the entire width of the ledger sheet 10 and divided by vertical lines 17 into four portions 14A, 14B, 14C and 14D corresponding to four columns. The first portion 14A is for receiving the specific medication information to be provided on the prescription label for each entry made. The second portion 14B is reserved for the price of the prescription and the druggist filling that prescription. The portin 14C is provided with suitable indexing means 16 in the form of a numeral with a circle around it (with successive entry lines having consecutive numbers from the top entry line down). The fourth portion 14D is for receiving additional notations (apart from the notations made on the label assembly) which may be desired depending upon the particular use to which the ledger sheet is employed. Thus, for example, the brand name of the medication dispensed may be entered in portion 14D. Of course, the ledger sheet also may be provided with or adapted to receive still other indicia, such as billing data, customer credit status, acknowledgments of waivers to relieve pharmacists of certain liabilities, etc. The master ledger sheet 10 also includes suitable slots 18 along its bottom horizontal edge for filing the master ledger sheet with like sheets in a suitable storage device such as one manufactured by the Visirecord Systems, of South Norwalk, Connecticut, a Division of Wright Line, Inc. of Massachusetts.

The multiple-sheet label assembly 12, shown in FIGS. 1–5, preferably includes top, release, intermediate and bottom sheets 20, 22, 24 and 26, respectively, all preferably made of paper or other suitable material. The top sheet 20 is preferably cut into several portions so as to provide a flap 28, writing area portions 30A and 30B and registration margin 32. As described in greater detail hereinafter, the flap 28, portions 30A and 30B and margin 32 are secured to the release sheet 22, with flap 28 being designed to be folded back with sheet 22 along line 33, where the edge of flap 28 lies adjacent ot the edge of writing area protion 30A, so that the flap 28 can be secured to the back of the master ledger sheet 10. As shown in FIG. 1 the widths of the writing area portions 30A and 30B and margin 32 are preferably approximately equal to the corresponding widths of portions 14A, 14B and 14C of the master ledger sheet 10. Preferably, the margin 32 is provided with an aperture 36 adapted to expose any one of the numerals of index means 16 which identify the entry line of ledger sheet 10 which will receive the information to be recorded on the writing areas 30 and transferred through sheets 22, 24 and 26. For reasons which will be more apparent hereinafter, the height of at least the writing area portions 30A and 30B is more than the height of one entry line of ledger sheet 10 (shown covering four entry lines) of the writing area portions 30A and 30B with the top part of top sheet 20 being subdivided and provided with indicia 38 designating the type of information to be recorded thereon and transferred through and recorded on the release, intermediate and bottom sheets 22, 24 and 26, respectively, as well as recorded on the particular entry line of ledger sheet 10 which has its indexing means 16 exposed through aperture 36 of the label assembly. The remaining part 40 of top sheet 20 below the part having indicia 38 is reserved to receive other information which is to be transferred through the sheets and recorded on the intermediate and bottom sheets 24 and 26. In the illustrated embodiment the part 40 is reserved for entry of the name of the person for whom a particular prescription is intended, and instructions regarding the use of the prescription.

Figure 3:
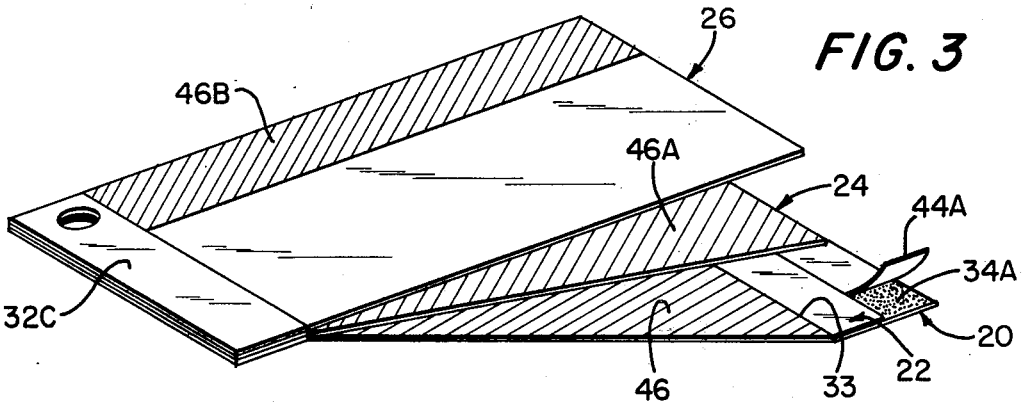
FIG. 3 is a bottom perspective view of the label assembly shown in FIG. 2.
Figure 4:
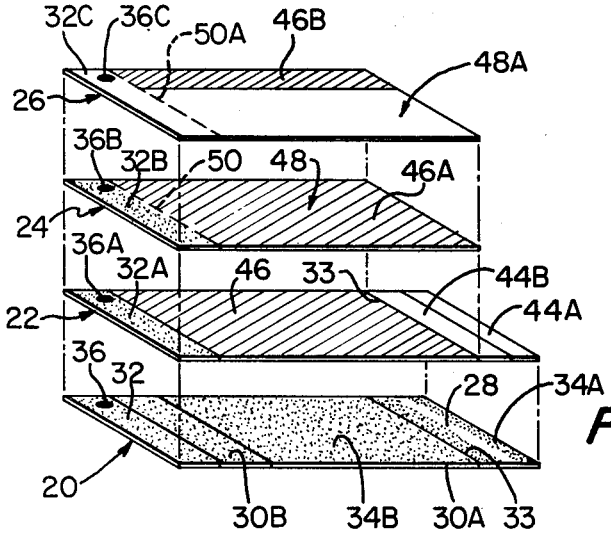
FIG. 4 is an exploded bottom perspective view of the label asssembly shown in FIGS. 2 and 3.

As shown in FIGS. 3 and 4, at least portions of the back surfaces of flap 28, writing area portions 30A and 30B and margin 32 of the top sheet 20 are provided with pressure senitive adhesive coatings 34 (A & B). More specifically, the border area of flap 28 is provided with a first adhesive coating 34A, and substantially the remaining portion of flap 28 and writing areas 30A and 30B and margin 32 are provided with a second adhesive coating 34B. Adhesive coatings 34A and 34B are of nonsetting type, with adhesive coating 34A providing sufficient adhesive strength for sticking to the back of ledger sheet 10 and yet being easily releasable without damaging sheet 10. Adhesive coating 34B provides sufficient adhesive strength for reasons which will be more apparent hereinafter.

Sheet 22 is designed to function as both a release sheet and carbon sheet and accordingly has its front surface, i.e. the surface facing top sheet 20, treated with a suitable release agent, such as silicone, so that the sheet 22 can easily be released from the adhesive coatings 34A and 34B. Sheet 22 comprises at least two separate parts 44A and 44B, the former for covering the adhesive coating 34A of flap 28 and the latter for covering the adhesive coating 34B of the remaining portion of flap 28, writing area portions 30A and 30B and margin 32. That portion of the rear side of sheet 22 corresponding to the writing area portions 30A and 30B is provided with a suitable pressure responsive duplicating means, indicated generally by reference numeral 46 in FIG. 4, such as a film of hot spot carbon or the like. The remaining portion 32A of sheet 22 corresponds to the margin 32 of sheet 20 and has a hole 36A aligned with aperture 36 of sheet 20.

Sheet 24 comprises a margin area 32B corresponding to margins 32 and 32A, and an aperture 36B aligned with aperture 36. Sheet 24 also includes a first duplicate copy 48 detachably secured to margin 32B along perforated line 50. Copy 48 corresponds to and is superimposed with area portions 30A and 30B so that all information provided in portions 30A and 30B including information written in the spaces provided by indicia 38 and the portion 40 therebelow, is transferred through duplicating means 46 of sheet 22. The rear side of copy 48, facing bottom sheet 26, is also provided with pressure responsive duplicating means 46A, identical to the means 46 of sheet 22, and is adapted to transfer all information provided in writing area portions 30A and 30B to bottom sheet 26.

Bottom sheet 26 comprises margin 32C, corresponding to margins 32, 32A and 32B, and includes an aperture 36C designed with apertures 36, 36A and 36B. Sheet 26 also includes a second duplicate copy 48A detachably secured to margin 32C along perforated line 50A. Copy 48A corresponds to and is superimposed with area portions 30A and 30B as well as copy 48 of sheet 24 so that all information provides in area portions 30A and 30B is transferred through the pressure responsive duplicating means 46A of sheet 24 and recorded on the front surface of the second duplicate copy 48A, i.e. that surface facing sheet 24. The rear side of sheet 26, the exposed surface designed to contact the front surface of the master ledger sheet 10, is also provided with pressure responsive duplicating means 46B, identical to duplicating means 46 and 46A of sheets 22 and 24, respectively, except that means 46B is only provided so as to be superimposed with the area of sheet 20 receiving indicia 38, so that entry information provided by the record keeper in the spaces provided by indicia 38 will be transferred therethrough.

All of the sheets 20, 22, 24 and 26 are secured together by securing the margins 32, 32A, 32B and 32C in a superimposed relationship by any suitable means preferably by a relatively strong adhesive or glue applied as a coating.

Figure 5:
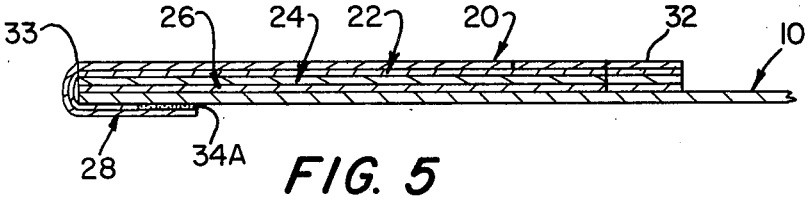
FIG. 5 is a cross-section taken along line 5—5 of FIG. 1.

In use, when a particular prescription is to be dispensed, the flap 28 of an assembly 12 is folded back along line 33 over the release, intemediate, and bottom sheets 22, 24 and 26. At the same time the release sheet portion 44A is removed by bending flap 28 sufficiently so that an edge of portion 44A separates from the adhesive coating 34A, and peeling the portion off to expose adhesive layer 34A. The crease formed along line 33 of the fold is then used to receive the left edge of the master ledger sheet 10 (as shown in FIGS. 1 and 5), so as to register the writing areas 30A and 30B of top sheet 20 with the respective columns 14A and 14B and so that indicia 38 of the top sheet 20 are superimposed over a selected entry line identified by the particular indexing means 16 exposed through aperture 36. Once properly registered, the adhesive 34A on the back of the flap is secured to the back surface of the ledger sheet by pressing the flap against the back surface. In this manner the entry can now be made, for example, by inserting the ledger sheet 10 together with the attached label assembly into a typewriter. The particular information recorded in the appropriate places designed by the indicia 38 is transferred through the duplicating means 46, 46A and 46B and recorded on duplicate copies 48 and 48A as well as the appropriate entry line of ledger sheet 10, while the patient identifying information provided in the area 40 of sheet 20 will be transferred through duplicating means 46 and 46A so as to record the information only on the duplicate copies 48 and 48A without recording the information on the ledger sheet.

Once the appropriate information has been entered, the writing area 30A of top sheet 18 can easily be removed by peeling it from the release sheet 22 and subsequently applying it directly to the prescription container. Similarly, the duplicated copies 48 and 48A may easily be removed by tearing them along the perforated lines 50 and 50A, one copy being intended as a receipt to the person receiving the prescription and the other being intended for internal use by the particular druggist. The remaining parts of the assembly can easily be removed from the master sheet 10 by peeling the flap 28 from the back surface of the ledger sheet and discarded.

Figure 6:
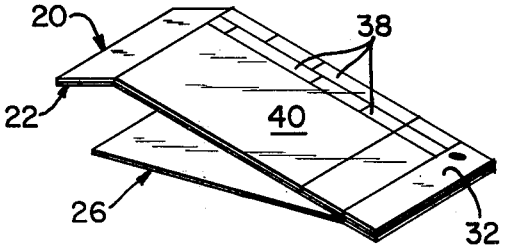
FIG. 6 is an top perspective view of the label assembly of an alternative embodiment of the present invention.

It will be appreciated that although the preferred embodiment has been shown as including an original (sheet 20) and two copies (sheets 24 and 26), the label assembly may include additional duplicate copies, or alternatively as shown in FIG. 6 may include only a single duplicate copy wherein sheet 24 has been omitted.

It will be appreciated that the record keeping system of the present invention is easy to use and easily adapted for use in pharmacies and other prescription dispensaries. Further, the label assembly and master ledger sheet are attached so that all entries including those on the master ledger sheet can be made simultaneously, without the necessity for subsequent steps, such as applying adhesive labels to the master ledger sheet.

What is claimed is:

1. A record keeping system comprising, in combination:

at least one master ledger sheet having a front and a back surface, the front surface being divided into a plurality of portions for receiving a like plurality of record keeping entries, said ledger sheet including indexing means corresponding to each of said portions; and at least one label assembly comprising first and second sheets, registration means for cooperating with said indexing means and including a flap for cooperating with said ledger sheet so as to superimpose said first and second sheets over a select one of said portions of said ledger sheet, said first and second sheets being detachably secured to one another so as to maintain said sheets in a superimposed relationship, said assembly further including pressure responsive duplicating means for transferring information from said first sheet to said second sheet and to said ledger sheet, said flap being detachably secured to one edge of at least one of said sheets and including means for securing said flap to said back surface of said ledger sheet so as to maintain said registration means in registration with said indexing means.

2. A system according to claim 1, wherein said first sheet includes an adhesive coating on the back of said sheet, said assembly further including a third sheet disposed between said first and second sheets, said third sheet being treated on its front surface so as to be releasable from said adhesive coating of said first sheet and treated on its rear surface with said pressure responsive duplicating means.

3. A system according to claim 2, wherein said first, second and third sheets each include a margin, said margins being secured together to maintain said first, second and third sheets in a superimposed relationship, said first and second sheets each including a portion removable from the corresponding margin.

4. A system according to claim 3, wherein said indexing means includes indicia indicative of a select one of said portions of said ledger sheet and said registration means includes an aperture through one or more of said first, second and third sheets positioned so as to expose select indicia of said indexing means through said aperture when said assembly is superimposed over said select one of said portions of said ledger sheet corresponding to said indicia.

5. A system according to claim 4, wherein said aperture extends through the margins of said first, second and third sheets.

6. A system according to claim 2, wherein said second sheet further includes said pressure responsive duplicating means on only a portion of the rear surface of said second sheet, so that information written on one area of said first sheet will be transferred through said third and second sheets, while information written on another area of said first sheet will be transferred through said third sheet and not through said second sheet.

7. A system according to claim 6, wherein said assembly includes a fourth sheet disposed between said third and second sheets, said fourth sheet including an area on its front surface for recording information written in said one area and said another area, and wherein said pressure responsive duplication means is on the back surface of said fourth sheet so as to transfer information written in said one area and said another of said first sheet to said second sheet.

8. A pharaceutical record keeping system for providing permanent records of prescriptions filled, at least one receipt and a label for a prescription package, said system comprising, in combination:

at least one master ledger sheet having a front and a back surface, the front surface being divided into a plurality of portions for receiving a like plurality of record keeping entries said ledger sheet including indexing means corresponding to each of said portions; and at least one multiple-sheet label assembly comprising at least two superimposed sheets, one of said sheets having at least a removable portion having an adhesive backing for securing said portion to said prescription package and the other of said sheets including at least a portion removable from said assembly so as to provide said receipt, said assembly further including pressure responsive duplicating means for transferring information from one of said sheets to the other of said sheets and to said ledger sheet, and registration means for cooperating with said indexing means and comprising a flap for cooperating with said ledger sheet so as to superimpose said sheets over a select one of said portions of said ledger sheet, said flap including means for detachably securing said flap to said back surface of said ledger sheet so as to maintain said registration means in registration with said indexing means.

9. A system according to claim 8, wherein said assembly further includes a third sheet superimposed with and disposed between said two sheets, said third sheet being treated on one side so as to be releasable from said adhesive backing of said removable portion of said one sheet, and treated on its other side and said pressure responsive duplicating means so as to transfer and record information to said other sheet.

* * * * *

UNITED STATES PATENT AND TRADEMARK OFFICE

CERTIFICATE OF CORRECTION

PATENT NO. 4,153,277

DATED May 8, 1979

INVENTOR(S) Gary J. Bellanca

It is certified that error appears in the above-identified patent and that said Letters Patent are hereby corrected as shown below:

| | |
|---|---|
| Column 2, line 36: | Delete the word "an" and substitute therefor the article "a" |
| Column 2, line 53: | Insert after the word "entry" the word "lines" |
| Column 2, line 63: | Delete the word "portin" and substitute therefor the word "portion" |
| Column 3, line 25: | Delete the word "ot" and substitute therefor the word "to" |
| Column 3, line 26: | Delete the word "protion" and substitute therefor the word "portion" |
| Column 3, line 60: | Delete the word "senitive" and substitute therefor the word "sensitive" |
| Column 4, line 44: | Delete the word "provides" and substitute therefor the word "provided" |
| Column 4, line 60: | Insert a comma (,) after the word "means" |
| Column 4, line 65: | Delete the word "intemediate" and substitute therefor the word "intermediate" |
| Column 5, line 16: | Delete the word "designed" and substitute therefor the word "designated" |

UNITED STATES PATENT AND TRADEMARK OFFICE

CERTIFICATE OF CORRECTION

PATENT NO. : 4,153,277

DATED : May 8, 1979

INVENTOR(S) : Gary J. Bellanca

It is certified that error appears in the above-identified patent and that said Letters Patent are hereby corrected as shown below:

| | |
|---|---|
| Column 6, line 54: | Delete the word "pharaceutical" and substitute therefor the word "pharmaceutical" |
| Column 8, line 9: | Delete "and" where it appears in the second instance and substitute therefor the word "with" |

Signed and Sealed this

*Second* Day of *October 1979*

[SEAL]

*Attest:*

RUTH C. MASON
*Attesting Officer*

LUTRELLE F. PARKER
*Acting Commissioner of Patents and Trademarks*